United States Patent [19]

Stephens

[11] Patent Number: 4,660,904

[45] Date of Patent: Apr. 28, 1987

[54] PORTABLE VOTING BOOTH/LECTERN

[76] Inventor: Richard J. Stephens, 6 N. 430 Burr Rd., St. Charles, Ill. 60174

[21] Appl. No.: 618,035

[22] Filed: Jun. 7, 1984

Related U.S. Application Data

[63] Continuation-in-part of Ser. No. 372,977, Apr. 29, 1982, Pat. No. 4,451,728.

[51] Int. Cl.[4] ..... A47B 96/18; A47B 3/00

[52] U.S. Cl. ..... 312/140.2; 312/258; 108/34

[58] Field of Search ..... 312/140.2, 223, 258, 312/259, 244, 239, 257 R, 257 A, 231, 233, 195; 108/36, 60, 34; 248/174; 190/11

[56] References Cited

U.S. PATENT DOCUMENTS

| | | | |
|---|---|---|---|
| 3,550,540 | 7/1968 | Albrecht | 312/258 |
| 4,451,728 | 5/1984 | McKay | 312/258 |
| 4,569,564 | 2/1986 | Ahmann | 312/258 |

*Primary Examiner*—Kenneth J. Dorner
*Assistant Examiner*—Gerald A. Anderson

[57] ABSTRACT

A portable voting booth/lectern having a generally horizontal support panel mounted on a plurality of detachable legs and to an upper surface of which may be attached a multi-section enclosure panel is disclosed. The enclosure panel is securely mounted to an upper surface of the support panel by inserting each of its foldably attached sections into a respective groove on an upper surface of the support panel. Four apertures on a lower surface of the support panel are adapted to receive a respective support leg, each of which is angled outwardly to provide a wide base for increased structural stability. The lower surface of the support panel includes a plurality of grooves, or recessed portions, into which the detached legs of two support panels may be positioned. With two support panels positioned adjacent one another and in alignment, the support legs of both panels may be positioned within the adjacent grooves of the two support panels. The entire assembly may then be inserted lengthwise into an elongated rectangular container fitted to the outer dimensions of the disassembled support panel and support leg arrangement to provide a compact, suitcase-like package to facilitate handling for improved portability.

9 Claims, 16 Drawing Figures

PORTABLE VOTING BOOTH/LECTERN

This application is a continuation-in-part of application Ser. No. 372,977, now U.S. Pat. No. 4,451,728, filed on Apr. 29, 1982 by Richard J. Stephens for "Portable, Foldable Voting Booth/Lectern", and assigned to the assignee of the present application.

BACKGROUND OF THE INVENTION

This invention relates generally to podium-like structures for use by one in a standing position and more particularly is directed to a low cost portable combination lectern/voting booth of sturdy construction and high stability which is easily disassembled and packaged for storage or shipment.

Foldable types of voting booths are well known in the prior art and generally are comprised of an upper, lectern-like, enclosed structure affording privacy for the voter. Examples of this type of voting enclosure may be found in U.S. Pat. Nos. 3,333,766 to Crossland et al, 3,531,171 to Boyer, and 3,544,184 to Laws. These structures are collapsible and generally comprised of a bottom wall and a plurality of upstanding side walls foldably coupled to the bottom wall and to each other. Voting booths of this type generally require a supporting structure, such as a table, since no provision for the elevated use of this type of voting booth is typically provided.

In some voting booths provision is made for supporting the enclosed voting area by an attached or integrated support structure. An example of a voting booth of this type may be found in U.S. Pat. No. 3,389,947 to Kelley et al, wherein is described a foldable voting booth forming a plurality of separate compartments supported by a number of foldable legs. A similar structure is disclosed in U.S. Pat. No. 3,361,090 to Howlett which relates to a shielded desk having a top with a back panel and side shields with each shield having a fixed wing and a hinged side panel and box-type shelves which can be used in either of two positions. This desk structure includes foldable supporting legs and the entire structure may be folded into a compact, portable unit. U.S. Pat. No. 3,455,255 to Sanchez discloses a foldable supporting structure having a plurality of legs as used in the two aforementioned patents. The structures disclosed in the aforementioned patents are complicated, expensive and are somewhat heavy thus limiting their portability. Thus, these structures would have limited utility as voting booths in view of the infrequent use of such structures, the relative complexity in setting up and taking down these enclosures and their relative expense.

U.S. Pat. No. 3,322,478 to Brown discloses a voting booth comprised of corrugated cardboard material which may be folded along predetermined lines to form a three-sided structure into which the voter walks for casting his ballot. The cardboard structure includes a shelf supported from a pair of supporting columns all of which are integrally coupled to the three vertical partitions comprising the voting booth. This voting booth configuration virtually entirely encompasses the voter in providing more privacy than generally required in the typical polling place and thus represents an overly complicated and excessive use of structural materials.

The present invention is intended to overcome the aforementioned limitations by providing an inexpensive, portable voting booth of sturdy construction which affords voter privacy and which is easily converted into a conventional speaker's lectern for general use.

OBJECTS AND SUMMARY OF THE INVENTION

Therefore, in view of the above, it is an object of the present invention to provide a combination voting booth/speaker's lectern which is simple in construction, easy to assemble and disassemble, stable and strong and relatively inexpensive to manufacture.

Another object of the present invention is to provide a combination voting booth/speaker's lectern comprised of a support panel mounted on a plurality of detachable legs to form either a generally flat, horizontal surface for use as a self-standing speaker's lectern or, in combination with a semi-rigid, foldable panel which can be firmly affixed to an upper surface of the support panel, a semi-enclosed structure for providing voter privacy.

A further object of the present invention is to provide a small, lightweight and inexpensive voting booth which is self-contained, permits the voter to record his vote in seclusion, and is easily assembled and disassembled for improved portability.

Yet another object of the present invention is to provide a portable voting booth/lectern which may be easily assembled to form a sturdy structure having a stable work surface and easily disassembled into a compact, suitcase-like structure for improved transportability.

The present invention contemplates a combination voting booth/speaker's lectern which includes a generally horizontal support panel detachably mounted on a plurality of support legs. The support legs are inserted in respective cylindrical apertures on a lower surface of the support panel, which cylindrical apertures are angled outwardly to provide an enlarged support base for increased stability. Recessed slots are also provided on the lower surface of the support panel for storage of the support legs upon voting booth/lectern disassembly. With the legs thus stored in the recessed slots of two adjacent, aligned support panels, the entire assembly may be easily inserted into an open end of a box-like structure to facilitate handling and shipment. An upper surface of the support panel includes a plurality of grooves around the periphery thereof and into which the lower edges of respective linked sections of a foldable upright panel may be inserted in tight fitting relation to provide the privacy required when the present invention is used as a voting booth. The present invention thus provides a sturdy, low cost structure which can be used either in an enclosed configuration as a voting booth, or as an open speaker's lectern which is easily assembled and disassembled and stored in a configuration which facilitates shipment and handling of the portable voting booth/lectern.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
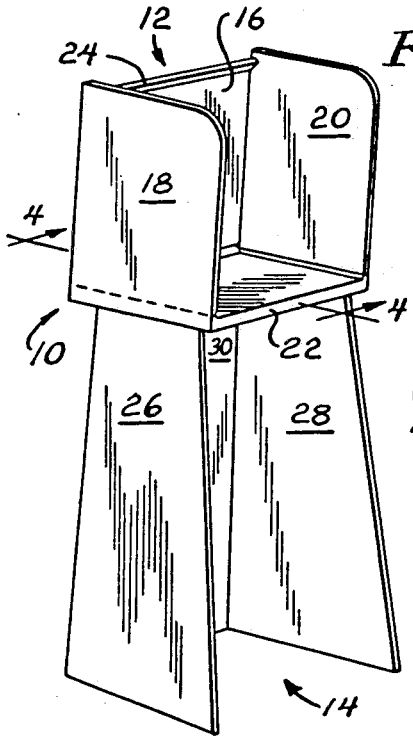
FIG. 1 is a perspective view of one embodiment of a combination voting booth/speaker's lectern.

Referring to FIG. 1, there is shown a perspective view of a combination voting booth and speaker's lectern 10. Voting booth/speaker's lectern 10 is comprised of an upper shelf element 12 and a lower, support element 14. The upper shelf element 12 and the lower, support element 14 are detachably coupled together in a manner to be described and each includes a plurality of articulated sections formed by folding a respective element along predetermined lines such as of perforations. In a preferred embodiment, the upper shelf and lower support elements 12, 14 are comprised of a corrugated cardboard composition, although any of the more common semi-rigid, workable structural materials could as easily be used herein.

In one embodiment the upper shelf element 12 includes a plurality of sections foldably coupled to a generally horizontal shelf 22. These foldable sections include a back wall 16 and side walls 18, 22. The back wall 16 and side walls 18, 20 are flexibly coupled to three lateral edges of the shelf 22 and in the voting booth configuration are positioned in a generally vertical orientation when assembled and in position. The distal edge of the back wall 16 includes an edge panel 24 foldably coupled thereto. Edge panel 24 is particularly adapted for the folded configuration of the upper shelf element and will be described below with respect thereto.

The lower support element 14 is also comprised of a single piece of a semi-rigid structural material, such as corrugated cardboard. By bending the lower support element 14 along two, parallel, predetermined lines, which may be defined by a linear arrangement of a plurality of perforations, the lower support element may be divided into three, attached sections. These sections include a support element back wall 30 and two side walls 34, 36 flexibly coupled thereto. The lower edge portions of back wall 30 and side walls 34, 36 generally form a planar array which functions as a base for stably supporting the portable voting booth/lectern 10.

Figure 2:
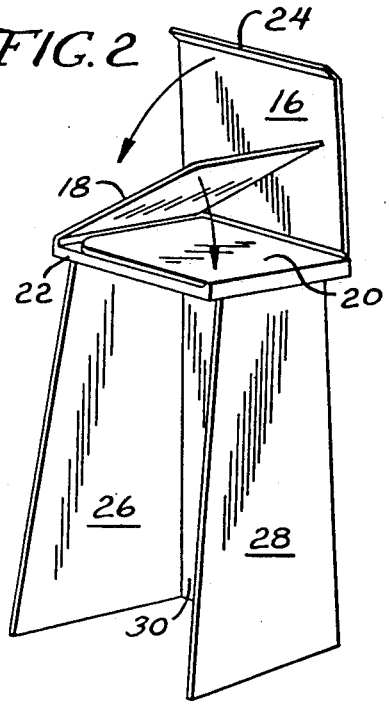
FIG. 2 is a partially folded side perspective view of the voting booth/speaker's lectern of FIG. 1.

Referring to FIG. 2, there is shown the portable voting booth/lectern 10 of FIG. 1 wherein the upper shelf element 12 is shown in a partially folded configuration. From FIG. 2 it can be seen that the side walls 18, 20 pivotally coupled to the shelf 22 of the upper shelf element 12 may be folded downward so as to be positioned generally parallel to and in close proximity to the upper surface of shelf element 12. In FIG. 2, side wall 20 has been folded so as to be positioned in close proximity to, or in contact with, the upper surface of shelf 22, while side wall 18 is in a slightly upraised, partially folded position. With the side wall 18 in the fully down position, the back wall 16 of upper shelf element 12 may then be folded downward as shown by the arrow in FIG. 2 so as to assume a generally horizontal position, parallel with the planes of shelf 22 and side walls 18, 20. This results in a very compact configuration of the upper shelf element 12 which facilitates the portability and storage thereof. With back wall 16 in the folded position, the edge panel 24 thereof may be folded and inserted between the upper surface of shelf 22 and side walls 18, 20 so as to cover the adjacent lateral edges of side walls 18, 20 in providing protection therefor.

Figure 3:
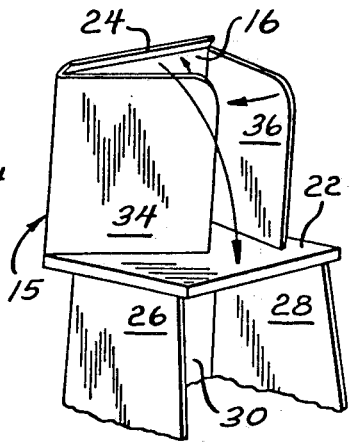
FIG. 3 is a partial perspective view of a partially folded second embodiment of the voting booth/speaker's lectern of FIG. 1 wherein the side walls of the upper shelf element are foldably coupled to the back wall thereof.

Referring to FIG. 3, there is shown a partial perspective view of a portable voting booth/lectern wherein a second embodiment of the upper shelf element is illustrated. In the embodiment of the upper shelf element 15 shown in FIG. 3, the side walls 34, 36 are pivotally coupled in a folding manner to back wall 16 rather than to the shelf 22 thereof as shown in the embodiment of FIGS. 1 and 2. FIG. 3 shows the upper shelf element 15 in a partially folded configuration wherein the side walls 34, 36 may be folded to a position in close proximity to the back wall of the upper shelf element and generally parallel to the plane thereof. With side walls 34, 36 thus folded, the shelf element's back wall 16 may then be folded downward so as to assume a position in close proximity and generally parallel to the plane of shelf 22. The edge panel of back panel 16 may then be folded so as to be positioned between the lower surface of the bottom side wall 36 and the upper surface of shelf 22. This configuration provides a smooth, continuous lateral surface of the upper shelf element 15 when used as a speaker's lectern. When utilized in this manner, the upper surface of back wall 16 provides a smooth, level and stable surface area for the lectern's user.

Figure 4:
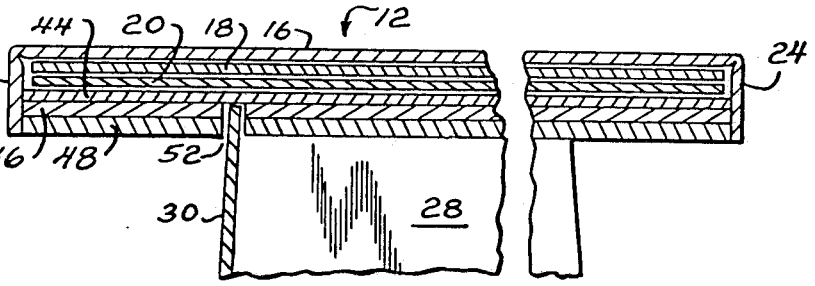
FIG. 4 is an enlarged sectional view taken along line 4—4 of FIG. 1, showing the supporting engagement of the shelf element by the support element.

Referring to FIG. 4, there is shown an enlarged sectional view of the portable voting booth/lectern 10 taken along line 4—4 of FIG. 1 with the shelf element 12 in the folded position. From FIG. 4 it can be seen that the shelf 22 includes a plurality of generally horizontally oriented panels which provide a reinforced surface for use by a voter or speaker. In FIG. 4 side walls 18, 20 have been folded to a generally horizontal position and are positioned immediately beneath back wall 16 which is also shown in a folded position. Immediately subjacent side side wall 20 is the upper surface panel 44 of the upper shelf element 12. Immediately subjacent upper surface panel 44 are sectioned panels 46, 48. As shown in FIG. 4, the space between adjacent sections of panels 46, 48 define a rear slot 52 running generally parallel to the back edge portion 58 of the shelf 22. When the upper shelf element 12 and the lower support element 14 are assembled, the upper portion of the back wall 30 of the support element is inserted within back slot 52 in an engaging manner. As shown in FIG. 4, the edge panel 24 of the back wall 16 is merely folded over the edges of side walls 18, 20 for their protection and is not inserted between the upper surface panel 44 and the side walls as previously described in another embodiment.

Figure 5:
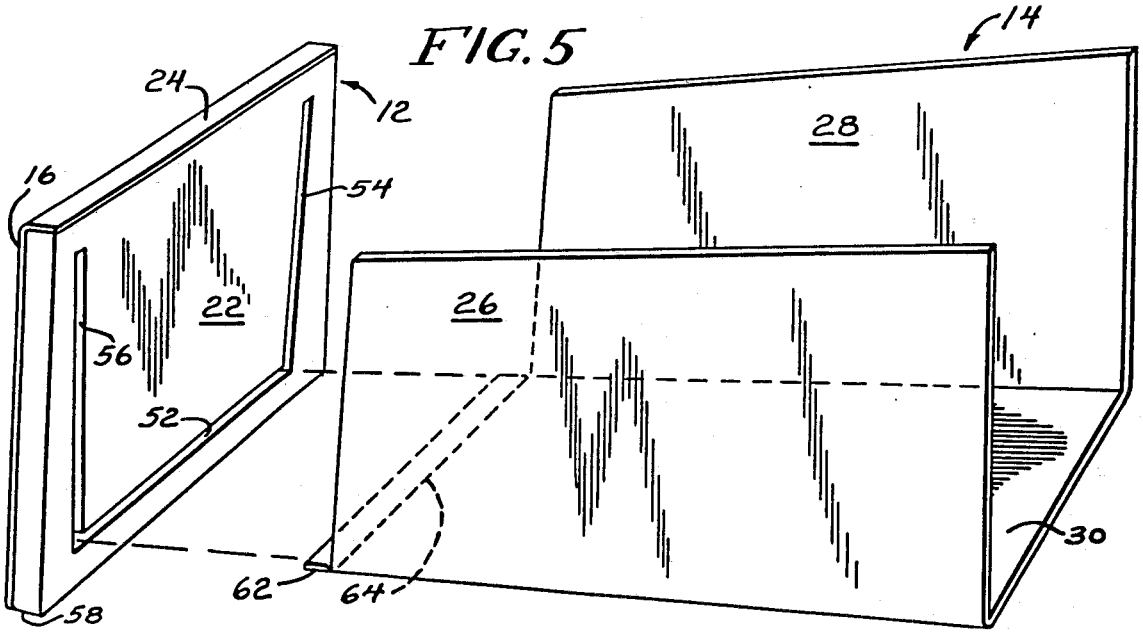
FIG. 5 is an exploded, perspective view of the voting booth/speaker's lectern of FIG. 1 showing the supporting engagement between the upper shelf element and the lower support element when assembled.

Referring to FIG. 5, it can be seen that the lower surface of shelf element 12 also includes lateral slots 54, 56 adjacent respective lateral edges thereof which join with rear slot 52 in defining a three-sided, continuous slot in the lower surface of upper shelf element 12. The upper shelf element 22 and the lower support element 14 are assembled by inserting the respective upper edge portions of back wall 30 and lateral walls 26, 28 into rear slot 52 and lateral slots 56, 54, respectively. In this manner, the upper shelf element and the lower support element are coupled together in a semi-rigid manner to permit the lower support element 14 to stably support the upper shelf element 12. These two elements of the portable voting booth/lectern may be easily separated in facilitating the disassembly thereof. Upper shelf element 12 may then be folded as previously described and lower support element 14 may be folded along predetermined lines as shown in FIG. 5 so that lateral walls 26, 28 are generally parallel and in close proximity to back wall 30. The portable voting booth/lectern 10 is then configured in two flat panels and may be easily carried and conveniently stored until next used.

In another embodiment, the upper edge of back wall 30 is provided with an extension portion 62 which is coupled in a flexible manner thereto. The upper edge of the extension portion 62 may be securely coupled in a conventional manner within the rear slot 52 of shelf element 12. Shelf element 12 then forms a single structural member with the lower support element 14 with the thus formed single unit foldable along line 64 in permitting the shelf element 12 to be positioned immediately adjacent and parallel to the folded lateral walls 26, 28 of the lower support element 14 for storage and/or shipping of the portable voting booth/lectern 10.

Figure 6:
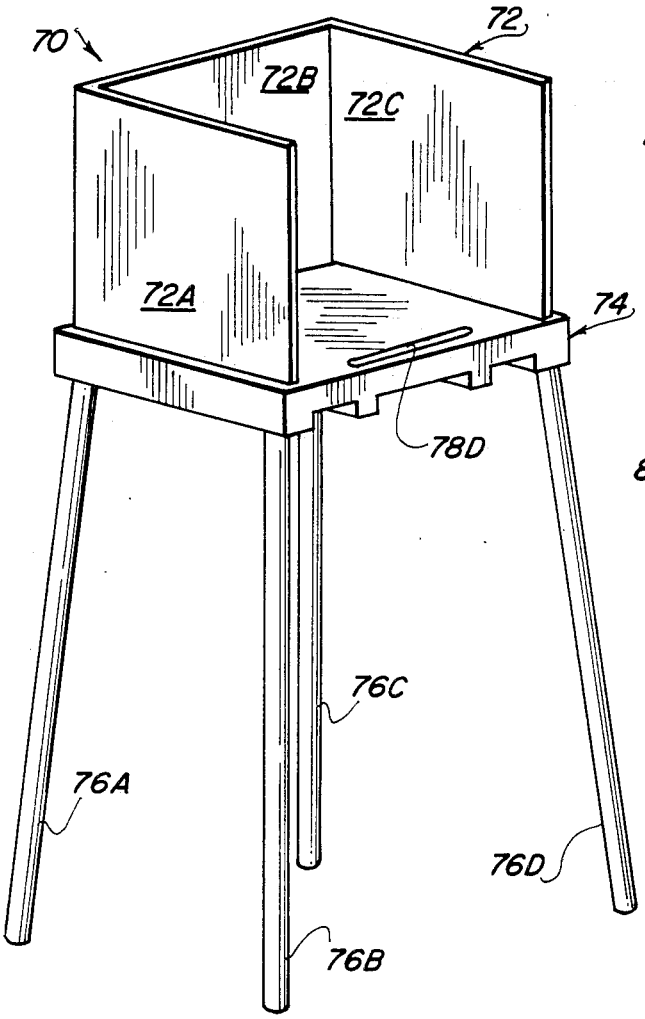
FIG. 6 is a perspective view of a portable voting booth/lectern in accordance with the present invention.
Figure 12:
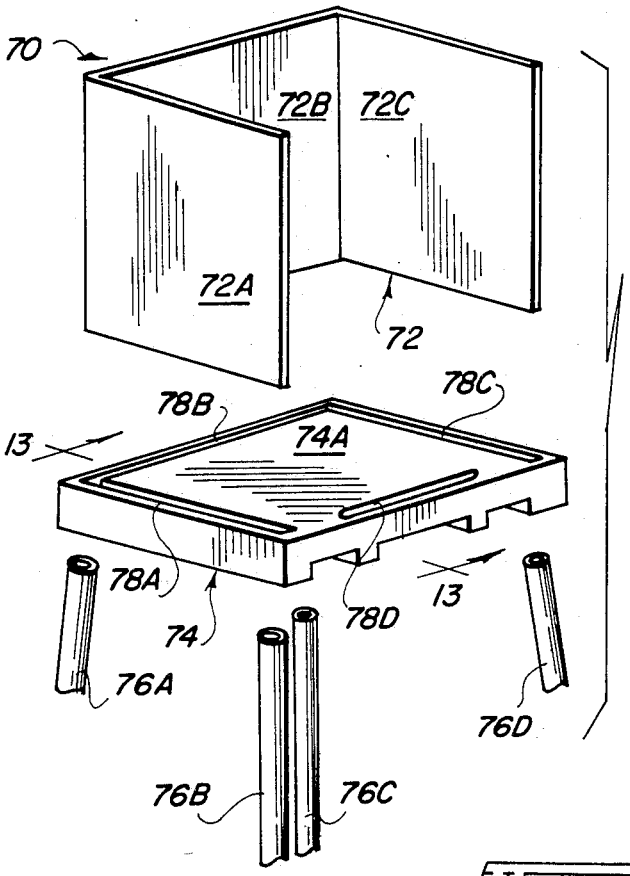
FIG. 12 is an exploded perspective view of a voting booth/lectern in accordance with the present invention.

Referring to FIGS. 6 and 12, there are respectively shown perspective and exploded perspective views of a voting booth/lectern 70 in accordance with the present invention. The voting booth/lectern 70 of the present invention includes a support panel 74 upon which is positioned an enclosure partition 72 and which is supported by and mounted upon a plurality of support legs 76A, 76B, 76C and 76D. Support panel 74 has generally a planar, rectangular shape and includes a flat upper surface 74A which includes around the periphery thereof a plurality of mounting grooves 78A, 78B and 78C. A fourth groove, or slot, 78D is positioned on an aft portion of the upper surface 74A of support panel 74 adjacent the periphery thereof. Slot 78D provides the stable positioning of an item such as a pencil on the upper surface 74A of support panel 74.

Positioned upon the upper surface 74A of support panel 74 within respective mounting grooves thereon is a foldable, multi-section enclosure partition 72 which is comprised of a pair of facing lateral walls 72A, 72C and a forward wall 72B. Respective lower edges of lateral walls 72A, 72C and forward wall 72B of enclosure 72 are inserted within respective lateral mounting grooves 78A, 78C and forward mounting groove 78B in the upper surface 74A of the support panel. The depth and width of the several mounting grooves in the upper surface of support panel 74 are such as to be in tight fitting relation with the respective walls of enclosure 72 so as to insure its stable and firm positioning on the upper surface of support panel 74. With enclosure 72 in position upon support panel 74, an enclosed work space is provided when the present invention is used as a voting booth. With enclosure 72 removed from the upper surface 74A of support panel 74 an open and firm work area is provided by the upper surface 74A of support panel 74. From FIG. 6, it can be seen that each of the support legs 76A, 76B, 76C and 76D is mounted to a respective corner of the lower portion of the support panel 74.

Figure 7:
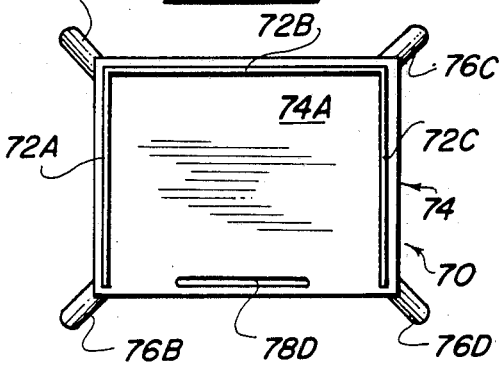
FIG. 7 is a top planar view of the voting booth/lectern of FIG. 6.
Figure 8:
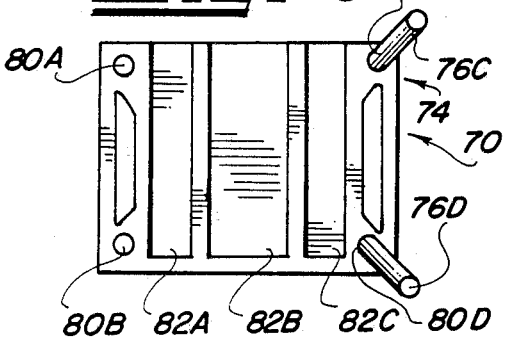
FIG. 8 is a bottom planar view of the voting booth/lectern of FIG. 6 with two of the four support legs removed therefrom.

Referring to FIGS. 7 and 8, there are respectively shown top and bottom planar views of the voting booth/lectern 70 of the present invention. The lower portion of support panel 74 is provided with a plurality of cylindrical mounting apertures 80A, 80B, 80C and 80D, each positioned adjacent a respective corner of support panel 74. These mounting apertures are cylindrical in shape to permit a respective support leg 76A, 76B, 76C and 76D to be inserted and firmly retained therein. Each of the mounting apertures 80A through 80D is oriented obliquely with respect to the lower surface of support panel 74. In addition, each of the mounting apertures is directed inwardly, toward the center of support panel 74 such that support legs inserted within these mounting apertures are directed outwardly from the center of support panel 74 in proceeding from the top to the bottom of each of the support legs. The attachment of support legs 76A through 76D to support panel 74 in this manner provides a support base which exceeds the lateral dimensions of support panel 74 for increased voting booth/lectern stability.

Slot 78D is positioned adjacent the lateral edge of support panel 74 closest to the position of the user of the voting booth/lectern 70. In addition, the lower surface of support panel 74 is provided with a plurality of recessed slots 82A, 82B and 82C. These recessed slots in the lower surface of support panel 74 extend almost the entire width of the support panel from front to rear. Recessed slots 82A, 82B and 82C are utilized when the voting booth/lectern 76 is disassembled in order to facilitate the shipping and handling thereof.

Figure 9:
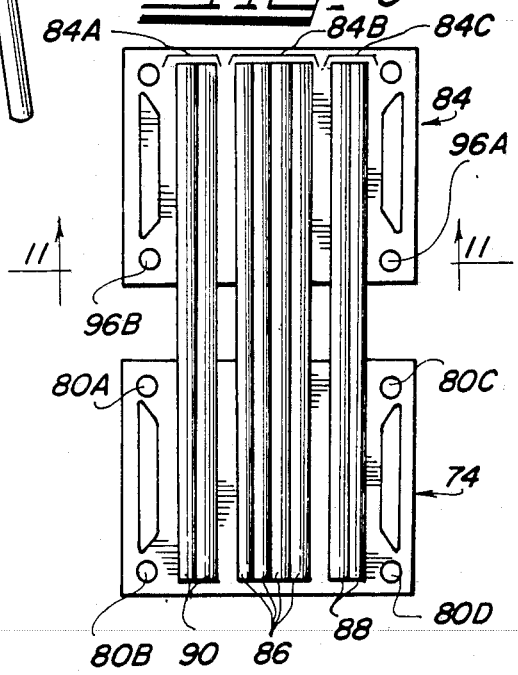
FIG. 9 shows two disassembled voting booths/lecterns which have been arranged for shipment or storage in accordance with the present invention.
Figure 11:
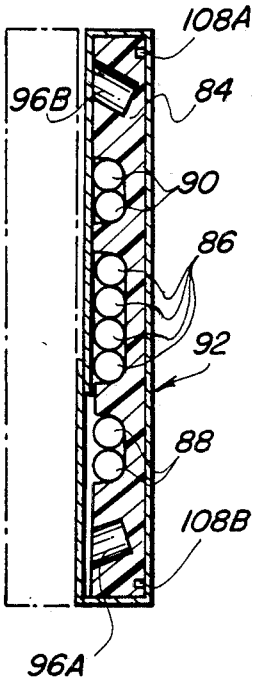
FIG. 11 is a sectional view of the disassembled voting booth/lectern shown in FIG. 9 taken along sight line 11—11 therein.
Figure 13:
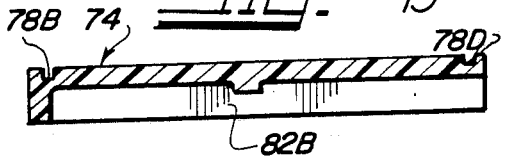
FIG. 13 is a sectional view of the exploded voting booth/lectern shown in FIG. 12 taken along sight line 13—13 therein.

Referring to FIG. 9, there are shown two voting booths/lecterns which have been disassembled and in the respective first and second support panels 74, 84 thereof are positioned the support legs upon which the support panels are mounted when assembled. As in the case of the first support panel 74, second support panel 84 includes lateral recessed slots 84A, 84C and a center recessed slot 84B. Two support legs 88 are positioned within aligned and adjacent lateral recessed portions of the first and second support panels 74, 84. Similarly, four support legs 86 are positioned within the aligned, adjacent center recessed slots of the first and second support panels 74, 84. The remaining aligned lateral recessed slots of the first and second support panels 74, 84 are shown as including support legs 90. FIG. 13 is a sectional view of the support panel 74 of the voting booth/lectern 70 of FIG. 12 taken along sight line 13—13 therein. Shown in FIG. 13 is the center recessed slot 82B on the lower surface of support panel 74 as well as forward mounting groove 78B and slot 78D on its upper surface. Shown in FIG. 11 is a sectional view of the second, or upper, support panel 84 shown in FIG. 9 taken along sight line 11—11 therein. The upper surface of the second support panel 84 includes lateral mounting grooves 108A, 108B. In addition, the angled orientation of mounting apertures 96A, 96B in the lower surface of support panel 84 can be seen. The outwardly directed orientation of mounting apertures 96A, 96B provides a wider support base at the lower ends of the respective support legs for increased voting booth/lectern stability.

Figure 10:
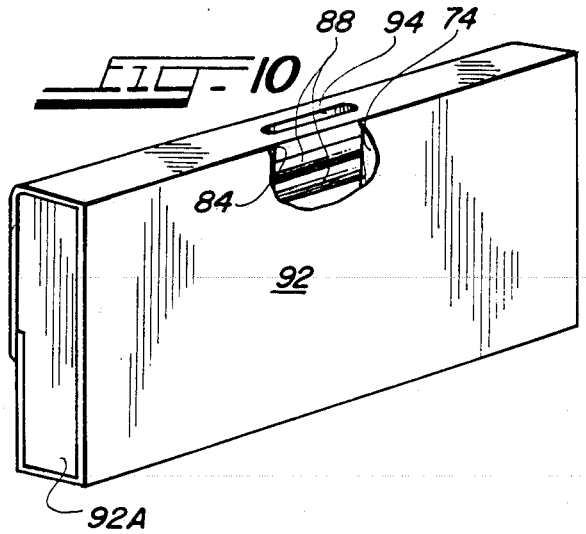
FIG. 10 is a partially cutaway perspective view of the disassembled voting booth/lectern arrangement of FIG. 9 which has been positioned within an open ended container.

Also shown in FIG. 11, positioned around and in tight fitting relation with support panel 84 and the support legs positioned therein, a first, multi-section, foldable enclosure 92. Foldable enclosure 92 may be open at one or both ends in order to permit the first and second support panels 74, 84 and support legs positioned therein to be inserted within the foldable enclosure and positioned along the length thereof. This permits two voting booth/lectern combinations, including all components associated therewith, to be placed within a single enclosure to facilitate handling and shipping or disassembled voting booth/lecterns. The foldable enclosure 92 may be comprised of a conventional material such as corrugated cardboard sealed in an overlapping fashion such as by a commonly available adhesive. A partially cutaway perspective view of the first and second support panels 74, 84 positioned within the foldable enclosure 92 is shown in FIG. 10. The foldable enclosure 92 includes at least one open end 92A for insertion of the combination of the first and second support panels with support legs therein. The lateral, outer portion of the foldable enclosure 92 may be provided with a conventional handle 94 by means of which the foldable enclosure and two disassembled voting booths/lecterns positioned therein may be easily handled.

Figure 14:
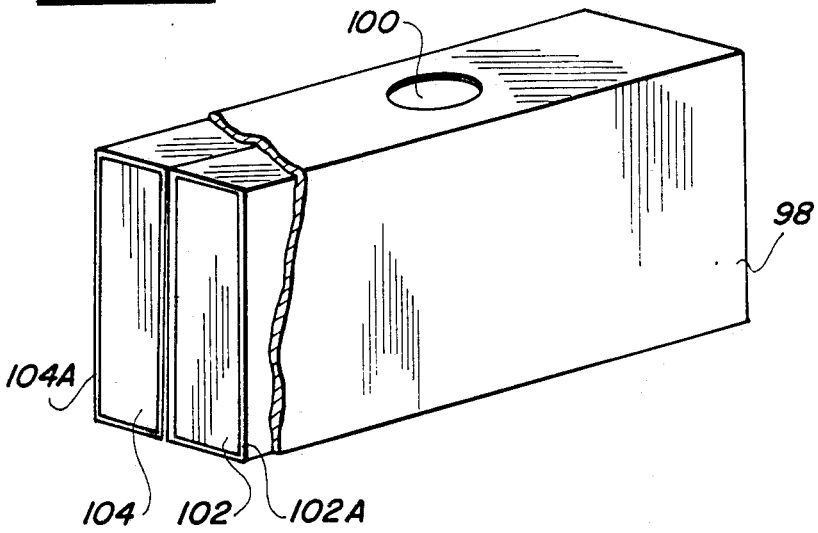
FIG. 14 is a partially cutaway perspective view of an arrangement for enclosing a plurality of voting booths/lecterns of the present invention in an open ended container for facilitating its portability.

Referring to FIG. 14, there is shown a partially cutaway perspective view of yet another arrangement for the storage, handling and shipping of several voting booths/lecterns in accordance with the present invention. In this arrangement, a larger foldable enclosure 98 is provided, within which four voting booths/lecterns may be positioned. Shown in the cutaway portion of FIG. 14 are second and third foldable enclosures 102A, 104A within which are respectfully positioned support panels 102 and 104 as well as an additional support panel in each foldable enclosure. Provided on an upper, lateral surface of the foldable enclosure 98 is an aperture 100 which provides access to the support legs (not shown) positioned therein. By inserting one's hand in aperture 100, the support legs positioned adjacent thereto may be easily grasped affording a means for picking up the entire assembly included within foldable enclosure 98.

Figure 15:
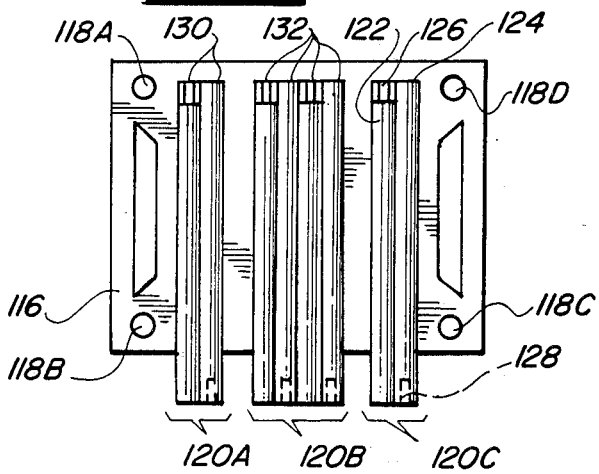
FIG. 15 shows another embodiment of a voting booth/lectern in accordance with the present invention which has been disassembled for shipment or storage.

Referring to FIG. 15, there is shown yet another embodiment of the present invention. In FIG. 15, a lower surface of support panel 116 includes a plurality of mounting slots 118A, 118B, 118C and 118D in respective corners thereof and into which a support leg is inserted when the voting booth/lectern is assembled for use. As previously described, the lower surface of the support panel 116 also includes a plurality of recessed portions 120A, 120B and 120C. When the voting booth/lectern is disassembled, a pair of support members 130 may be positioned within recessed portion 120A and a pair of support members 122, 124 may be positioned within recessed portion 120C. Similarly, four support members 132 may be positioned within recessed portion 120B when the voting booth/lectern is disassembled. As shown in the figure, each support member includes either an insert 126 or a slot 128 at one end thereof. This complementary slot and insert configuration permits a pair of support members to be joined at complementary ends thereof so as to form a two-section support leg. This permits each support member to be shorter than if it comprised an entire support leg and allows the support panel 116 to encompass each support member substantially along its entire length when the voting booth/lectern has been disassembled for storage and/or transport.

Figure 16:
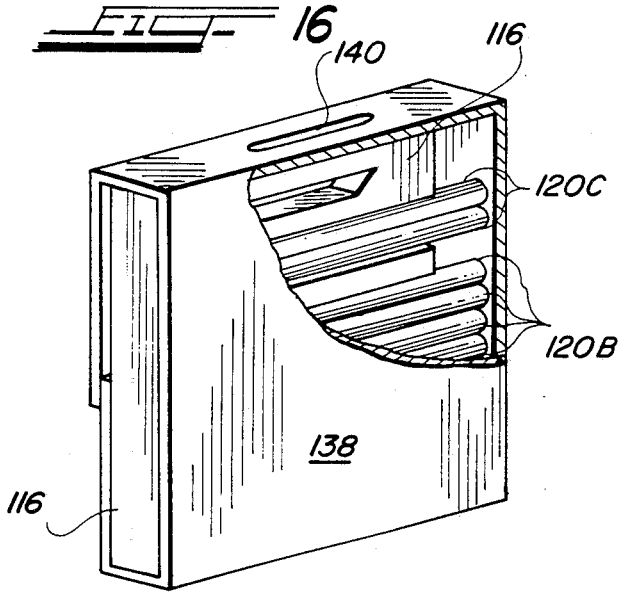
FIG. 16 is a partially cutaway perspective view of the disassembled voting booth/lectern arrangement of FIG. 15 which has been positioned within an open ended container.

Referring to FIG. 16, there is shown a partially cutaway perspective view of support panel 116 positioned within a foldable enclosure 138. Positioned within the recessed portions 120B and 120C (recessed portion 120A is not shown in FIG. 16) are a plurality of aligned support members. This arrangement provides a compact, fully enclosed container for the shipment and/or storage of a disassembled voting booth/lectern. On an upper surface of the foldable enclosure 138 is provided a handle 140 which may either be merely an aperture in the surface of the foldable enclosure or may extend from the foldable enclosure 138 to which it is securely mounted.

There has thus been shown a portable voting booth/lectern which is stable, inexpensive, easily assembled and disassembled, and is adapted for ease of handling to facilitate its transportability. In one configuration, a generally upright, multi-section enclosure provides user privacy when used as a voting booth, or the enclosure structure may be easily removed to provide a flat, stable shelf for use such as a lectern.

The portable voting booth/lectern of the present invention may be fabricated from readily available materials. For example, the multi-section panel enclosure partition 72 may be comprised of cardboard. Similarly, support legs 76A, 76B, 76C and 76D are also fabricated from rolled cardboard in a preferred embodiment. Support panel 74 is preferably comprised of a conventional plastic material and may be fabricated using well-known injection molding techniques.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In combination, a portable voting booth/speaker's lectern and means for the storage and transport thereof, said combination comprising:

a foldable, multi-section partition;

a plurality of elongated support legs;

a generally flat, rectangular panel having a plurality of coupled grooves on a first, upper surface adjacent the periphery thereof for receiving in tight fitting relation a respective lower edge of a section of said partition in providing for the stable mounting of said multi-section partition on said first upper surface of said panel, said panel further including on a second, lower surface thereof:

a plurality of apertures adapted to receive in tight fitting relation a respective support leg in providing for the stable support of said panel; and an elongated recessed portion extending substantially the length of said panel and adapted to receive said support legs lengthwise when removed from the apertures of said panel; and an elongated container including upper, lower and facing lateral flat walls and having an open end portion and adapted to receive at least a pair of said panels therethrough, wherein, with the respective recessed portions of said panels in facing and aligned arrangement and said support legs positioned in the facing, aligned recessed portions of said panels, the panels, legs and all components associated therewith of at least a pair of said voting booths/speaker's lecterns are securely stored in said container for storage or transport.

2. The combination of claim 1 wherein said panel includes generally rectangular upper and lower surfaces and wherein said upper surface includes three grooves positioned adjacent respective forward and lateral edges thereof.

3. The combination of claim 2 further including a fourth groove on the upper surface of said panel positioned adjacent a rear edge thereof.

4. The combination of claim 2 wherein each of said apertures is positioned adjacent a respective corner of the lower surface of said panel.

5. The combination of claim 3 wherein each of said apertures defines an elongated slot in the lower surface of said panel and wherein each of said elongated slots is aligned generally toward the center of said panel such that the distal ends of said support legs extend beyond the lateral portions of said panel for increased voting booth/lectern stability.

6. The combination of claim 1 wherein said apertures are circular and said support legs have cylindrical cross sections.

7. The combination of claim 1 wherein said container includes gripping means on the upper wall thereof for facilitating the transport of said container with said panels, legs, and all components associated therewith positioned therein.

8. The combination of claim 1 wherein the lower surface of said panel includes a plurality of elongated recessed portions adapted to receive said support legs lengthwise when removed from the apertures of said panel.

9. In a portable voting booth/speaker's lectern including a support panel having upper and lower surfaces and a plurality of support legs and a partition detachably coupled to said upper surface of said support panel, an improved arrangement for transporting and storing a pair of said voting booth/speaker's lectern when disassembled comprising:

storage means including respective elongated recessed portions in said lower surface of each of said support panels for receiving said support legs lengthwise when detached from said support panels in a stored configuration, wherein said support panels are arranged such that the respective elongated recessed portions thereof are in facing, aligned relation to accommodate said legs, and enclosure means for receiving a pair of said support panels arranged in said stored configuration and into which the combination of said support panels, support legs and all components associated therewith and stored therein when a pair of said voting booth/speaker's lectern is disassembled may be inserted to facilitate the storage and transport thereof.

* * * * *